United States Patent [19]

Lindsey, Jr.

[11] 4,399,873

[45] Aug. 23, 1983

[54] RETRIEVABLE INSERT LANDING ASSEMBLY

[75] Inventor: Hiram E. Lindsey, Jr., Midland, Tex.

[73] Assignee: MWL Tool and Supply Company, Midland, Tex.

[21] Appl. No.: 274,284

[22] Filed: Jun. 16, 1981

[51] Int. Cl.[3] ..... E21B 23/03; E21B 23/04

[52] U.S. Cl. ..... 166/380; 166/382; 166/387; 166/217; 166/212

[58] Field of Search ..... 166/380, 382, 387, 212, 166/208, 217, 124, 120, 121, 125, 123, 122; 285/140

[56] References Cited

U.S. PATENT DOCUMENTS

| | | | |
|---|---|---|---|
| 3,136,364 | 6/1964 | Myers | 166/212 X |
| 3,827,488 | 8/1974 | Piazza et al. | 166/208 X |
| 3,893,717 | 7/1975 | Nelson | 166/208 X |
| 4,059,150 | 11/1977 | Manderscheid | 166/212 X |
| 4,254,829 | 3/1981 | Watkins | 285/140 X |

*Primary Examiner*—Ernest R. Purser
*Assistant Examiner*—Michael J. Starinsky

[57] ABSTRACT

Apparatus and method of positioning and seating a retrievable insert landing assembly within a packer bore receptacle in a well bore. Means are provided for releasably securing a landing assembly in the packer bore receptacle by engaging an annular groove in the PBR with latching elements on the landing assembly. The latching elements are normally in a retracted position and are actuated by hydraulic pressure. The landing assembly has an internal polished bore which slidably and sealingly receives a tubular extension attached to a releasable coupling. The releasable coupling is disconnectable from the landing assembly after it is latched in place. To retrieve the landing assembly a spear mechanism is run in the tubing and an upward pull shears a release mechanism in the landing assembly. The retrievable landing assembly is hydraulically set and mechanically retrieved.

12 Claims, 6 Drawing Figures

RETRIEVABLE INSERT LANDING ASSEMBLY

FIELD OF THE INVENTION

This invention relates to oil well production tools for oil wells and more particularly, to a retrievable insert landing assembly for use in a packer bore receptacle system.

DESCRIPTION OF THE PRIOR ART

Packer bore receptacle systems (or "PBR" systems) are typically employed on top of a production liner in conjunction with a liner hanger disposed in a well bore. A PBR typically has a long polished bore which slidably and sealingly receives a sealing assembly on the end of a tubing string. Thus, the tubing end is free to move a calculated distance by expansion or contraction without affecting the seal.

A retrievable landing device is intended for use within a PBR and permits use of smaller size tubing or plugging for remedial work. The retrievable landing device typically uses a multiple latching lugs to latch the device into a pre-cut groove in the PBR.

Heretofor, a retrievable landing device has been mechanically set, after inserting the device in the well bore and after it contacts a no-go shoulder. Setting is accomplished by setting down weight on the device to force a shear pin to release and to set the latch or lug means in the pre-cut latching groove in the production packer bore. The energy for setting the latch or lug means in the latching groove comes from a compressed spring in the tool. A system of this type is illustrated in the 1980–81 Composite Catalog of Oilfield Equipment and Service, 34th Revision on page 6883.

For a number of reasons these mechanical devices have problems which include failure of the setting mechanism to operate downhole for one reason or another and inability to set or retrieve the device easily. In addition, with mechanically operated devices which are shear pin released, they are subject to premature setting whenever the tool hits an obstruction or shoulder while going into the hole.

In some instances where it is desired to utilize smaller tubing, a device known as an insert seal assembly ("ISA") is utilized. Such an assembly is described in the 1980–81 Composite Catalog of Oilfield Equipment & Service, 34th Revision at page 6864.

This type of equipment requires removal of the entire unit landing when the tubing is removed.

In the type of equipment described, these problems are overcome by the present invention by providing a hydraulically operated setting mechanism so that a landing device for a PBR is positively operated and the latch or lug means are positively in in the PBR groove. Thereafter the setting tool is disconnected from the PBR and left in the hole with an extension of the tubing forming a sliding seal.

Accordingly, it is an object of the present invention to provide a method for setting production tools and apparatus for a retrievable insert landing assembly which is hydraulically operated.

DESCRIPTION OF THE INVENTION

The present invention includes a retrievable landing tool which is insertable through a string of pipe in a well bore and which seats in the bore of the production string, usually a polished bore receptacle (PBR). When seated in the bore, a sealing ball is dropped through the tubing and hydraulic pressure is applied to the tubing string and the ball which seats in the landing tool. When the ball is seated, the applied hydraulic pressure causes a shear pin in the landing tool to sever and to permit the pressure applied to a tubular setting sleeve to shift the setting sleeve longitudinally relative to a tubular setting collar and positively project radially movable latching elements in the setting collar into engagement with a latching groove in the production bore tubing. The setting collar and setting sleeve are telescopically and releasably locked relative to one another while the latching elements are in an extended position.

The setting tool is released by right hand rotation so that an interconnecting traveling nut on the setting tool disconnects from the PBR and the setting tool and tubing can be moved upwardly relative to the PBR. Below the setting tool, there is a tubing extension with seal members slidably received in a polished bore of the setting collar. Thus it is not necessary to retrieve the tubing and setting tool after the landing assembly is latched into place in the PBR.

Thereafter, the tubing can be retrieved or replaced without affecting the PBR or landing assembly. If it is desired to retrieve the landing assembly from the PBR, then the tubing is retrieved and a spear can be coupled to the setting sleeve to retrieve the landing assembly from the PBR. The spear engages the setting sleeve to pull it upwardly and shear a releasable locking means between the body and sleeve. Once the locking means are released, the setting sleeve is movable upwardly and it allows the latching elements to retract from the latching groove in the packer bore receptacle. Thereafter the landing assembly can be retrieved from the tubing.

A DESCRIPTION OF THE PREFERRED EMBODIMENT

The drawings do not illustrate the well bore but it will be understood by those skilled in the art that a PBR or Polished Packer Bore Receptacle 10 as referred to herein is disposed in the well bore traversing earth formations and is connected by a string of tubing to the surface.

Figure 1:
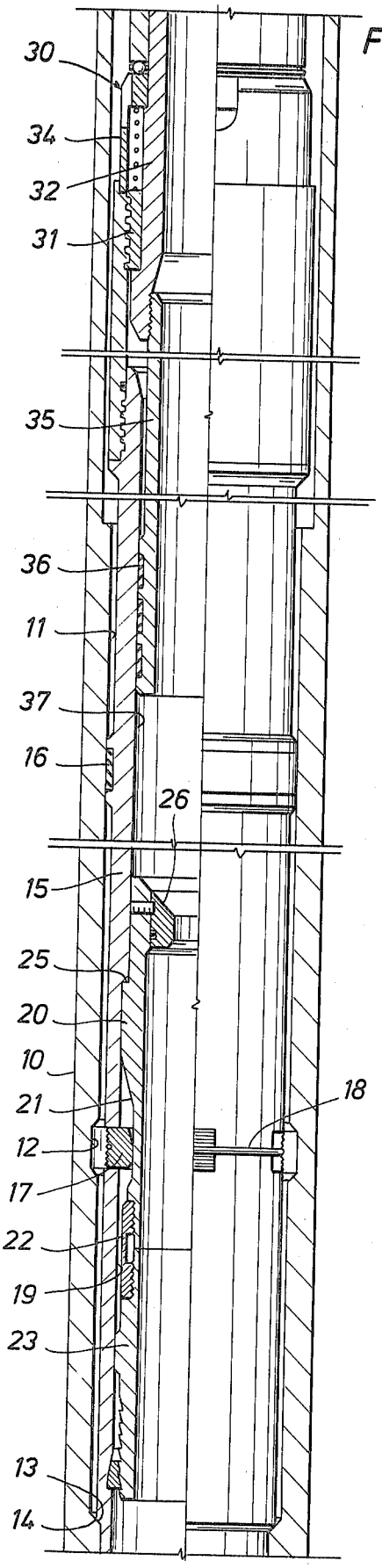
FIG. 1 is a view in longitudinal cross-section which depicts the over-all construction of the present invention in a PBR.

Referring now to FIG. 1, a schematic illustration of an embodiment is made for purposes of presenting a general explanation of the present invention. In FIG. 1, a PBR 10 has an elevated polished bore 11 which has an annular locking groove 12 along its length which is located just above an upwardly facing annular landing seat or shoulder 13. The landing seat 13 is adapted to be engaged by the landing seat 14 on a setting collar 15. The setting collar 15 has external sealing means 16 which slidingly engage the polished bore 11 of the PBR.

Adjacent to the annular locking groove 12 are circumferentially spaced rectangular slots in the setting collar 15 which slidably receive latching elements 17. The latching elements 17 are shown in a retracted position and are normally retained in a retracted condition by an annular resilient element 18. Slidably received in the lower bore 19 of the setting collar 19 is a tubular setting sleeve 20. The tubular setting sleeve 20 has an annular recess 21 along its length with an inclined bowl portion which is adapted upon downward movement of the setting sleeve to extend the latching elements 17 into locking engagement with the locking groove 12. The setting sleeve 20 is connected by a shear coupling member 22 to a locking sleeve 23. The locking sleeve has an external ratchet section which engages a ratchet ring in a locking recess in the bore 19 of the setting collar 15. When the locking sleeve is moved downwardly the ratchet ring and ratchet prevent return movement of the locking sleeve and thus the latching elements 17 may be locked in an extended or set condition. The shear coupling member 22 may be broken to shift the setting sleeve 20 upwardly to release the latching elements 17 from a locked position.

The setting sleeve 20 at its upper end has a shoulder 25 which engages downwardly facing abutment in the setting collar 15 for retrieving purposes. At the upper end of the setting sleeve 20 is a shear release ring 26 which is releasable to permit a spear to engage with the setting sleeve 20.

In the upper end of the setting collar 15, a coupling tool 30 is attached by an internal threaded portion to the setting collar 15. The coupling tool 30 has a threaded nut member 31 which is slidably and non-rotatively coupled to mandrel housing 32. Above the nut member 31 the coupling tool 30 carries a rotatable cage member 34 which has a hollow annular recess for receiving the nut member 31 upon rotation of the coupling tool 30 relative to the setting collar 15. Below the nut member 31, the coupling tool has an elongated tubular extension member 35 which carries external seals 36 which are slidably and sealingly received within a polished bore 37 of the setting collar 15. Thus, with the coupling tool released, the tubing and extension 35 can be left in the bore 37 by virtue of the sliding seals 36.

Referring now to FIGS. 2(A–D), a more detailed illustration of the apparatus is set forth. In FIGS. 2A–2D a Polished Bore Receptacle ("PBR") 10 is threadably and sealingly connected at its lower end to a PBR sub 10 which, in turn, is threadably connected to a conventional liner hanger (not shown). The PBR 10 is tubular with a uniform polished section of internal bore 11 along its length. Near the lower end of the internal bore 11 (FIG. 2D) is an annular landing groove or recess 12. The PBR sub has an annular bore 40 which is smaller in diameter than bore 11 and the bores 11 and 40 are joined by a conical, upwardly facing surface which defines a landing seat or shoulder 13 where the shoulder 13 is a "No-Go" shoulder. The retrievable insert landing assembly ("RILA") of the present invention is designed to pass through the bore 11 of the PBR 10 until a lower, downwardly facing, shoulder 14 on the nose of the ("RILA") engages the landing seat 13 in the PBR sub.

Figure 2A:
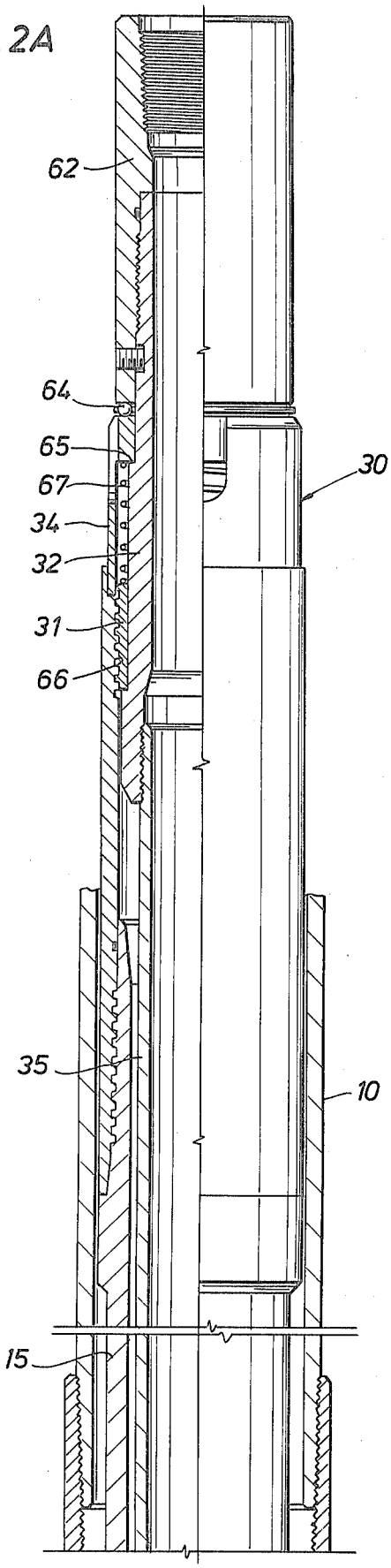
FIGS. 2A, 2B, 2C and 2D are longitudinal cross-sections thru a retrievable insert landing assembly within a packer bore receptacle in a position immediately prior to the time that hydraulic pressure is applied to set the landing assembly in a locked position in the packer bore receptacle.
Figure 2B:
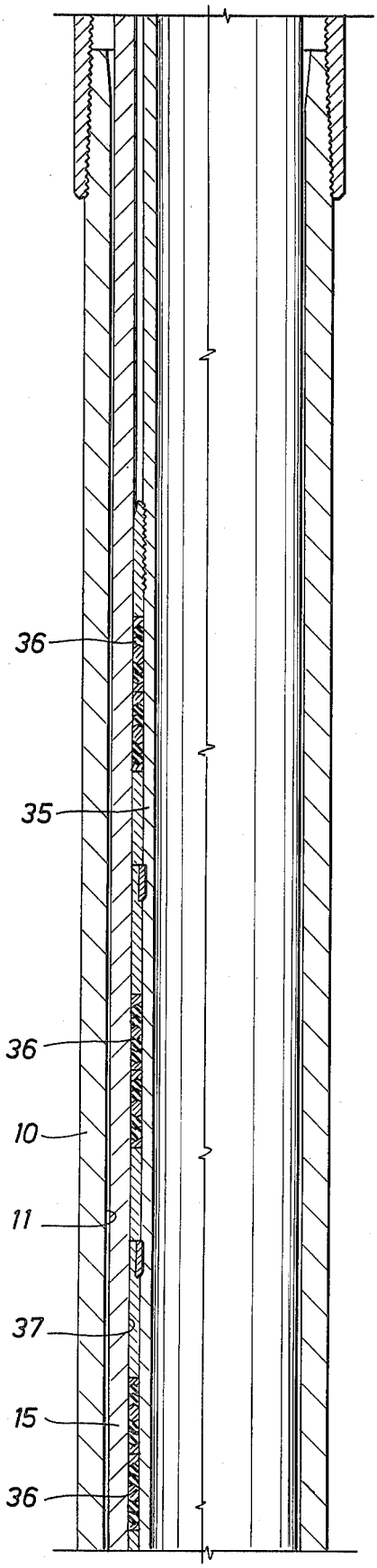
Figure 2C:
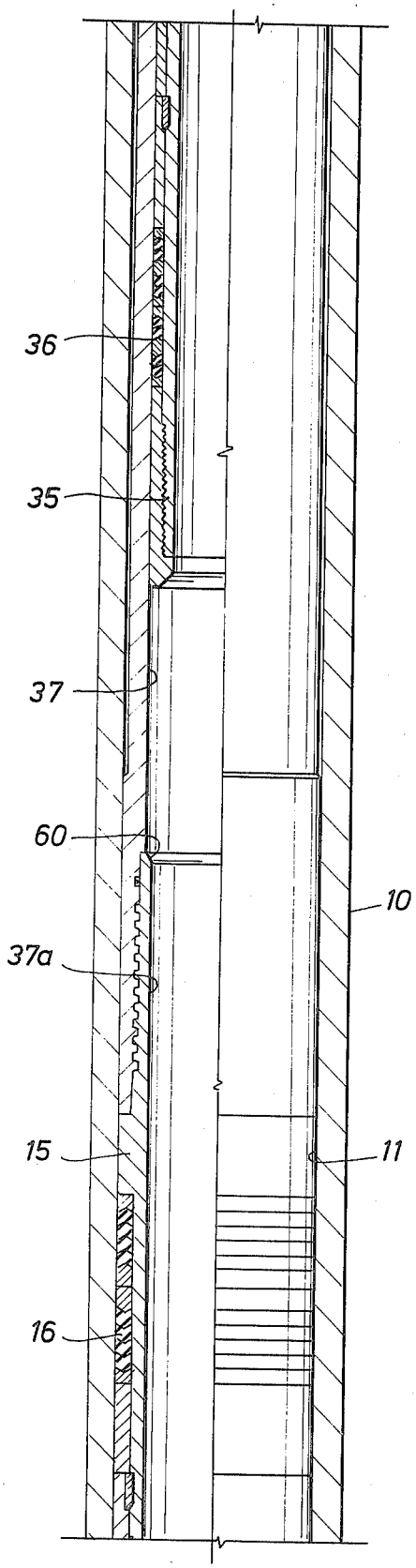
Figure 2D:
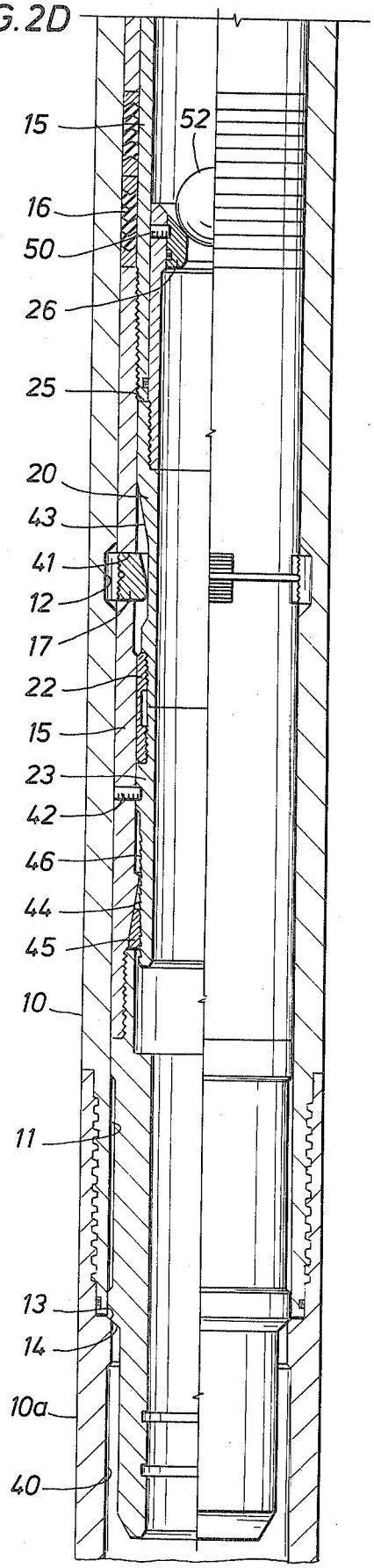

The setting collar 15 has an external packing members 16 (FIGS. 2C and 2D) for sealing and sliding reception within the bore 11 of the PBR 10 when the shoulder 14 is seated on the landing seat 13 (FIG. 2D). A tubular setting sleeve 20 (FIG. 2D) is slidably received within the setting collar 15 and, in an uppermost position, the sleeve 20 has an annular shoulder 25 which engages a downwardly facing shoulder on the collar 15. Below the packing means 16, when the RILA is seated on the shoulder 13, there are circumferentially spaced openings 41 in the setting collar 15 which are disposed adjacent to the annular locking groove 12 in the PBR 10. Rectangularly shaped latching elements 17 with exterior griping teeth are disposed within the spaced openings 41 so as to move inwardly and outwardly with respect to the setting collar 15 and thus, into and out of the annular setting groove 12 in the PBR 10. The setting sleeve 20 and the setting collar 15 are normally releasably coupled to one another by shear pin means 42. At the lower end of the setting sleeve 20, there is a recess which has a tapered cone surface 43 adapted to cooperate with tapered surfaces on the latching elements 17. Thus, upon downward movement of the setting sleeve 20 with respect to the setting collar 15, the tapered surface 43 wedges the locking elements 17 positively into engagement with the annular locking groove 12. To retain the setting sleeve 20 in a downward locked position with respect to the locking elements 17, the setting collar 15 is provided with an internal cylindrical recess 44 which carries a split, annular ratchet ring 45. The ratchet ring 45 is arranged to engage with a ratchet surface 46 on a locking sleeve 23 upon downward movement of the setting sleeve 20 after the shear pin 42 is sheared at a predetermined pressure range. Engagement of the ratchet ring 45 and the ratchet 46 prevents a return motion of the setting sleeve 20 and keeps the latching elements 17 mechanically locked into position in the groove 12.

The setting sleeve 20, at its upper end, has an annular shear ring 26 which is coupled by a shear pin 50 to the sleeve 20. The shear ring 26 is sized to receive a sealing ball 52. When the sealing ball 52 is in place in the ring 26 then hydraulic pressure applied within the tubing can move the pressure sleeve 20 downwardly and break the shear pin 42. In the downward movement of pressure sleeve 20, the latching elements 17 are wedged outwardly into engagement with the annular groove 12 and the ratchet ring 45 engages the ratchet 46 to lock the setting sleeve 20 in its downward position. Additional hydraulic pressure shears the pin 50 so that the ring 26 and ball 52 pass through the sleeve 20.

Figure 3:
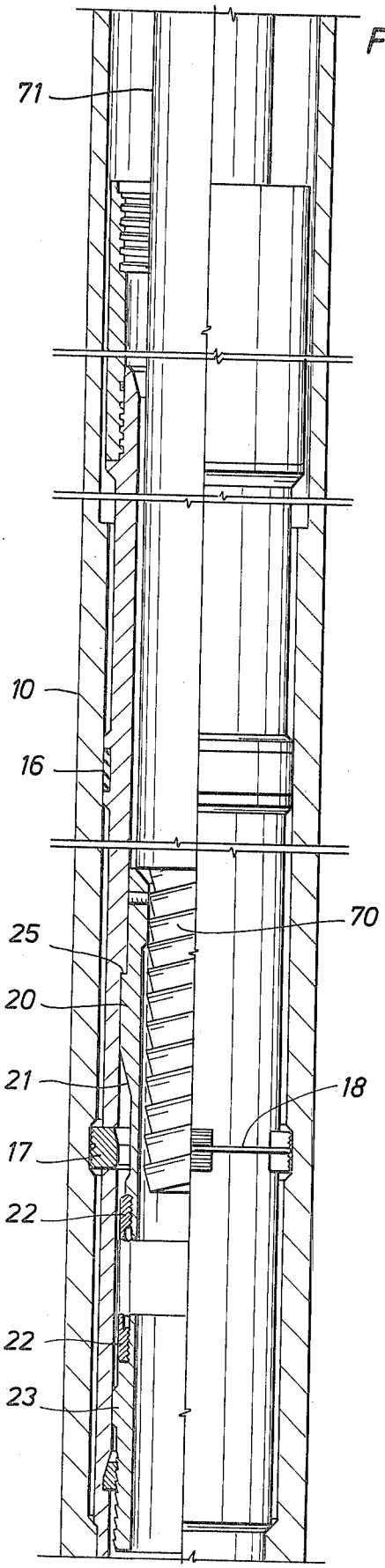
FIG. 3 is a view similar to FIG. 1 but illustrating the tool in the position where the PBR is retrieved.

Referring now to FIG. 3, to release the setting sleeve 20 from its downward position after the bore through the sleeve 20 is opened, a fishing tool or spear 70 on a tubing string 71 can be latched to the sleeve 20 so that an upward pull will shear the coupling 22 and release the latching elements 17 from the locking groove 12.

The setting collar 15, setting sleeve and other parts, as illustrated in the drawings, consist of interconnected tubular members provided with o-ring seals. As shown in FIG. 2C, the inner lower bore **37*a* of the collar 15 is slightly smaller in diameter than the upper bore 37 so that a stop shoulder 60 is provided for the tubing extension 35**.

Releasably attached to the upper end of the setting collar 15 is a releasable coupling tool 30 (FIG. 2A) which has an upper tubular sub 62 which is threadably and sealingly coupled to a downwardly extending tubular mandrel 32. An o-ring seal is disposed between the mandrel 32 and sub 62 to provide a fluid tight seal. At the outer, upper end of the tubular mandrel 32 is a rotatably mounted tubular cage member 34. The rotatable mounting for the cage member 34 is provided by an annular ball bearing unit 64 and an upwardly facing shoulder 65 on the mandrel 32. The cage member 34 has fluid pressure relief ports through its side wall to permit passage of fluid. The downwardly facing end of the cage member 34 engages an upwardly facing end of a tubular setting collar 15. The tubular setting collar 15, at its upper end, has an interior threaded portion 66, which threadedly engages a traveling nut 31 which is longitudinally slidable on the mandrel 32. A compression spring 67 is disposed between the upper end of the traveling nut 31 and the cage member 34 to assist in assembly by forcing the nut 31 out from within the cage member 34. The traveling nut 31 is splined longitudinally to the mandrel 32 to permit sliding non-rotative movement. When the mandrel 32 is rotated, the traveling nut 31 will be rotated relative to the collar 15 so that it can move longitudinally upward with respect to the mandrel 32. The nut 31 thus serves as a releasable connection between the mandrel 32 and the setting collar 15.

Below the mandrel 32 is a depending tubing 35 which has seals 36 along its length (FIGS. 2B & 2C). When the mandrel 31 is released from the setting collar 15, the seals can slide within the polished bore 37.

In the operation of the system, a retrievable landing assembly is attached to the coupling tool 30 and lowered through the string of casing or tubing on a string of tubing until the setting collar 15 engages the stop or landing seat 13 at which time the locking elements 17 are disposed adjacent to the locking groove 12. The ball 52 is dropped into the tubing string and hydraulic pressure aplied to the tubing string. The hydraulic pressure shifts to the sleeve 20 downwardly so that the shear pin 42 (FIG. 2D) is sheared at a predetermined pressure and the latching elements 17 are extended or moved outwardly by the tapered surface 43 into the locking groove 12. When the latching elements 17 are fully extended, the split ratchet ring 45 has locking teeth which engage the ratchet 46 and retains the sleeve 20 in a downward position with respect to the setting collar 15. A simple pull up on the tubing can determine if the latching elements have indeed latched into locking groove 12.

The tubing attached to the sub 62 is rotated to the right which permits the traveling nut 31 to be rotated with the mandrel 32 relative to the setting collar 15. The nut 31 is rotated out of threaded engagement with the setting collar 15 and the mandrel 32 can be uncoupled from the collar 15 and the tubing extension 35 is slidably and sealingly received in the bore 37. At the same time the setting collar 15 is releasably latched in the packer bore receptacle 10.

Should it become necessary to pull or replace the tubing, the tubing is completely retrievable, as previously described, leaving the PBR 10 still in place. Should it be desired to retrieve the PBR 10 after the tubing is retrieved, a fishing tool or spear 70 is passed into the PBR 10 to engage with the setting sleeve 20. Thereafter, an upward pull on the sleeve 20 shears the shear coupling 22 and the shoulder 25 engages the downwardly facing shoulder on the setting collar 15. The upward movement of the sleeve 20 releases the latching elements 17 from the latching groove 12 and the setting collar is thus removable. In this process the ball 52 and shear ring 26 are previously removed by hydraulic pressure and have dropped to the bottom of the bore.

Should it become necessary to re-enter the lower part of the well the RILA is completely retrievable, as previously described, leaving the full internal bore of the casing open to use workover tools.

While various embodiments are illustrated, the scope of the invention is included within the claims that follow.

What is claimed is:

1. A method of setting a retrievable insert landing assembly in a packer bore receptacle in a well bore comprising the steps of:

lowering a retrievable inset landing assembly and coupling tool on a string of tubing through a string of pipe containing a packer bore receptacle until the retrievable insert landing assembly is sealingly received in the packer bore receptacle and is seated therein;

dropping a sealing ball through the tubing string to seal off the cross-section of the landing assembly so that a setting force may be applied to the retrievable insert landing assembly;

applying hydraulic pressure to said tubing string after the ball is seated in the landing assembly for latching said insert retrievable insert landing assembly to a packer bore receptacle;

disconnecting said coupling tool from the retrievable insert landing assembly after the actuation of the retrievable insert landing assembly while providing a sliding seal between said coupling tool and said landing assembly so that it is not necessary to halt production of the well to retrieve the tubing after setting of said landing assembly.

2. A retrievable insert landing asembly for use in a packer bore receptacle in a well bore where said packer bore receptacle has a polished bore, a landing seat and a latching groove disposed intermediate of the length of said polished bore, said retrievable insert landing assembly including:

a telescopically coupled setting sleeve and setting collar, said setting collar having a lower downwardly facing seating surface for engagement with an upwardly facing landing seat in a packer bore receptacle;

said setting collar having latching means which are radially movable between extended and retracted positions relative to said setting collar, said latching means being responsive to longitudinal movement of said setting sleeve so that in one longitudinal telescopic position of said setting sleeve, said latching means are retracted and in another longitudinal telescopic position of said setting sleeve, said latching means are extended into a locking relationship with a latching groove in a packer bore receptacle;

release means for releasably interconnecting said setting sleeve and setting collar in one of said longitudinal positions to retain said latching means in an extended position;

means for temporarily closing off the cross-section of said setting sleeve so that hydraulic pressure can be applied to move said setting sleeve between said telescopic positions;

tubular extension means slidably and sealingly received in the upper end of said setting collar above said means for temporarily closing off the cross-section of said setting sleeve;

tool means for releasably coupling said tubular extension means to the upper end of said setting collar, and said tool means being operative upon rotation to release said tubular extension means from said setting collar for sliding and sealing movement relative to said setting collar.

3. The retrievable insert landing assembly as defined in claim 2 wherein said tool means includes an internal threaded portion on the setting collar and a nut means threadedly received in said setting collar, said nut means being slidably and non-rotatively mounted on said tool means whereby upon relative rotation between said tool means and setting collar that said nut means may be disengaged from said setting collar.

4. The retrievable insert landing assembly as defined in claim 3 wherein said tool means includes a tubular cage member rotatively mounted on a housing mandrel and having a lower end to engage the upper end of said setting collar, said cage member having an internal recess sized to receive said nut means upon relative rotation between said housing mandrel and setting collar.

5. The retrievable insert landing assembly as defined in claim 4 wherein said release means includes an annular ratchet ring on one of said setting collar and said setting sleeve for retaining said setting sleeve and setting collar in a longitudinal telescopic position when said latching means are extended in their locking relationship.

6. The retrievable insert landing assembly as defined in claim 5 wherein said release means include a frangible sleeve element which will separate to release said setting sleeve from said setting collar upon a predetermined force being applied to said setting sleeve.

7. The retrievable insert landing assembly as defined in claim 6 wherein said shear element comprises a shear coupling disposed above said release means.

8. A retrievable insert landing assembly for use in a packer bore receptacle having a polished sealing bore with a latching groove intermediate of the length of said sealing bore and a lower upwardly facing landing seat including:

a telescopic setting sleeve and setting collar sized to be slidingly and sealingly received within a sealing bore of a packer bore receptacle, said setting collar having a downwardly facing seating surface for engagement with a landing seat in a packer bore receptacle, means for releasably latching and unlatching said setting sleeve with respect to a packer bore receptacle in response to longitudinal movement of said setting sleeve with respect to said setting collar;

coupling tool means sized for passage through a packer bore receptacle on the end of a string of tubing, release means releasably connecting said coupling tool means to said setting collar, said coupling tool having a tubular extension slidably and sealingly received within said setting collar at a location above said setting sleeve;

said setting sleeve having means for providing a fluid tight passage whereby hydraulic pressure may be applied to said setting sleeve for moving said setting sleeve relative to said setting collar and thereby setting said latching means.

9. The apparatus as defined in claim 8 wherein said means for providing a fluid tight passage includes an annular seat member, adapted for receiving a sealing ball, and shear pin means for releasably connecting said annular seat member to said setting sleeve.

10. The apparatus as defined in claim 8 wherein said means for releasably latching and unlatching said setting sleeve includes an annular ratchet latching ring on one of said setting collar and setting sleeve for retaining said setting sleeve and said setting collar in a longitudinal telescopic position when said latching means are extended in their locking relationship.

11. The apparatus as defined in claim 10 and further including a frangible sleeve element between said setting sleeve and said ratchet latching means, said frangible sleeve element being adapt to separate for releasing said setting sleeve from said ratchet latching means upon a predetermined force being applied to said setting sleeve.

12. A retrievable landing assembly for use in a packer bore receptacle in a well bore where said packer bore receptacle has a polished bore, a landing seat and a latching groove disposed intermediate of the length of said polished bore, said retrievable landing assembly including:

a telescopically coupled setting sleeve and setting collar, said setting collar having a lower downwardly facing seating surface for engagement with an upwardly facing landing seat in a packer bore receptacle;

said setting collar having latching means which are radially movable between extended and retracted positions relative to said setting collar, said latching means being responsive to longitudinal movement of said setting sleeve so that in one longitudinal telescopic position of said setting sleeve, said latching means are retracted and in another longitudinal telescopic position of said setting sleeve, said latching means are extended into a locking relationship with a latching groove in a packer bore receptacle;

release means below said latching means for releasably interconnecting said setting sleeve and setting collar in longitudinal positions where said latching means are in an extended position, said release means being separable upon the application of a predetermined force to permit movement of said setting sleeve relative to said setting collar for permitting retraction of said latching means; and releasable barrier means in said setting sleeve adapted to receive a sealing element for closing the bore of said setting sleeve so that a first hydraulic pressure, when applied, can produce longitudinal movement between said setting collar and setting sleeve and so that upon the application of a second and greater hydraulic pressure said barrier means is released to pass downwardly through said setting sleeve.

* * * * *